US006960076B2

(12) United States Patent
Yu

(10) Patent No.: US 6,960,076 B2
(45) Date of Patent: Nov. 1, 2005

(54) ELECTRONIC SWITCH FOR DROP-FREE CANDLE

(76) Inventor: Shung-Lun Yu, 3F-1, No. 14, Lane 54, Sec. 3, Hsi Sheng S. Rd., Taipei (TW)

( * ) Notice: Subject to any disclaimer, the term of this patent is extended or adjusted under 35 U.S.C. 154(b) by 0 days.

(21) Appl. No.: 10/681,162

(22) Filed: Oct. 9, 2003

(65) Prior Publication Data

US 2005/0079463 A1 Apr. 14, 2005

(51) Int. Cl.[7] ..... F23D 3/16
(52) U.S. Cl. ..... 431/253; 431/289
(58) Field of Search ..... 431/253, 289, 431/291, 288, 292, 126; 362/161, 810, 554

(56) References Cited

U.S. PATENT DOCUMENTS 3,744,957 A * 7/1973 Wright, Sr. ..... 431/126
4,477,249 A * 10/1984 Ruzek et al. ..... 431/253
4,568,269 A * 2/1986 Lin ..... 431/253
4,983,119 A * 1/1991 Lin ..... 431/253
5,015,175 A * 5/1991 Lee ..... 431/253
5,807,096 A * 9/1998 Shin et al. ..... 431/253
6,050,812 A * 4/2000 Chuang ..... 431/253
6,074,199 A * 6/2000 Song ..... 431/253

FOREIGN PATENT DOCUMENTS

FR 2 637 721 A * 4/1990

* cited by examiner

*Primary Examiner*—Josiah C. Cocks
(74) *Attorney, Agent, or Firm*—Dennison, Schultz, Dougherty & MacDonald

(57) ABSTRACT

An electronic switch for a drop-free candle is comprised of a candle, a wick, a metal disk, a conductor and a circuit board; the metal disk being buried in the candle; the conductor being provided in the form of an optical fiber or a magnet twisted pair cable; the conductor being provided along the wick to control the operation of the circuit board provided at the bottom of the candle to realize the function of an electronic switch while preventing drops of the fatting substance of the candle.

2 Claims, 5 Drawing Sheets

ELECTRONIC SWITCH FOR DROP-FREE CANDLE

BACKGROUND OF THE INVENTION (a) Field of the Invention

The present invention is related to an electronic switch for a candle, and more particularly, to a conductor comprised of a optical fiber or a magnet twisted pair cable provided along a wick of the candle to control flaring, musical and other candle light variations while preventing drop of the fatty substance of the candle.

(b) Description of the Prior Art

Whereas a conventional candle is no longer a strictly portable light, its application tends to try multiple-layer and multi-directional development particularly in the entertaining purpose. Electronic flaring candle and musical candle are now generally available in the market. Usually, the burning wick controls the flaring or musical function. As the candle must be ignited to flare or sound musical tones, an electronic switch to control the candlelight is introduced. The switch while controlling the inherited electronic device in the candle also controls other electronic devices. However, the candlelight control device of the prior art is comparatively complicate to present certain difficulties in mass production.

Furthermore, a candle usually contains a linen or cotton wick. The burning wick produces heat to raise the temperature of and melt the candle in peripheral into fatty oil before being eventually consumed by the burning wick. However, it is difficult to control the flame of the candle and the burning wick may not keep straight all the time. The diverged flam often winds up that the certain part of the candle to the peripheral of the wick melts faster and even creates a gap. The fatty substance of the candle flows out to become drops that affect the appearance of the candle and quickly consume the candle.

SUMMARY OF THE INVENTION

The primary purpose of the present invention is to provide an electronic switch that prevents the burning candle from creating any drop, thus to ensure the complete combustion of the candle but also eliminate drop resulted from diverged wick or flame for improved safety.

To achieve the purpose, the present invention is essentially comprised of a candle, a wick, a metal disk, a conductor and a circuit board. Wherein, the metal disk is provided inside the candle, and the conductor provided along the wick relates to a optical fiber or magnet twisted pair cable; so that once the candle is ignited, the conductor controls the circuit board provided at the bottom of the candle to realize the function of an electronic switch while the metal disk prevents the drop of the fatty substance of the candle.

Whereas the optical fiber is provided along the wick, the candlelight is emitted through the optical fiber to a photosensitive device closely connected to the optical fiber. The light then enabled the photosensitive device to control the operation of the electronic switch.

When the magnet twisted pair cable is used as the conductor, the cable is also provided along the wick. Once the candle is ignited, the temperature of the cable rises to melt the coating of the cable, and the cable is conducted to function as a switch.

To the present invention, the candle is melted not by the heat from the flame, instead, by the heated metal plate. Therefore, the melting is achieved at constant speed to eliminate the gap while the metal plate also stops the fatty substance from escaping to ensure complete combustion of the candle without creating drop.

DETAILED DESCRIPTION OF THE PREFERRED EMBODIMENTS

Figure 1:
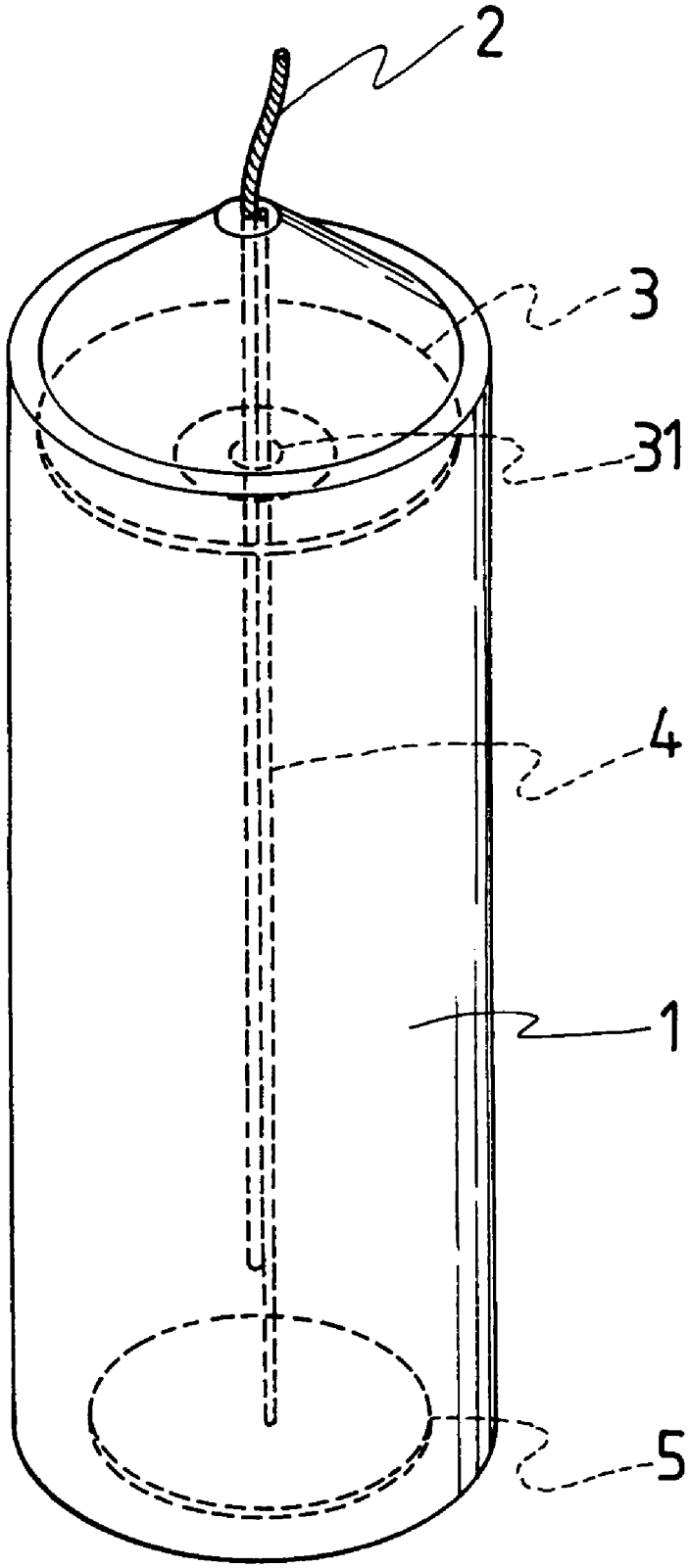
FIG. 1 is a perspective view of a preferred embodiment of the present invention.

Referring to FIG. 1, a drop-free electronic switch of the present invention is essentially comprised of a candle 1, a wick 2, a metal disk 3, a conductor 4, and a circuit board 5. The present invention controls the electronic device by means of the burning candle to ensure complete combustion of the candle without creating drops due to diverged wick or flame for improved safety in use. Wherein, the wick 2 made of cotton is axially provided in the candle 1 for the wick 2 to stay burning on the top of the candle 1. A metal disk 3 made of aluminum foil and indicating a V shape is buried in the upper part of the candle 1. A circular opening 31 is provided at the center of the metal disk 3 to allow the wick 2 to penetrate through the metal disk 3. The circuit board 5 is provided at the bottom of the candle 1 and connected to a conductor 4 along the wick 2.

Figure 2:
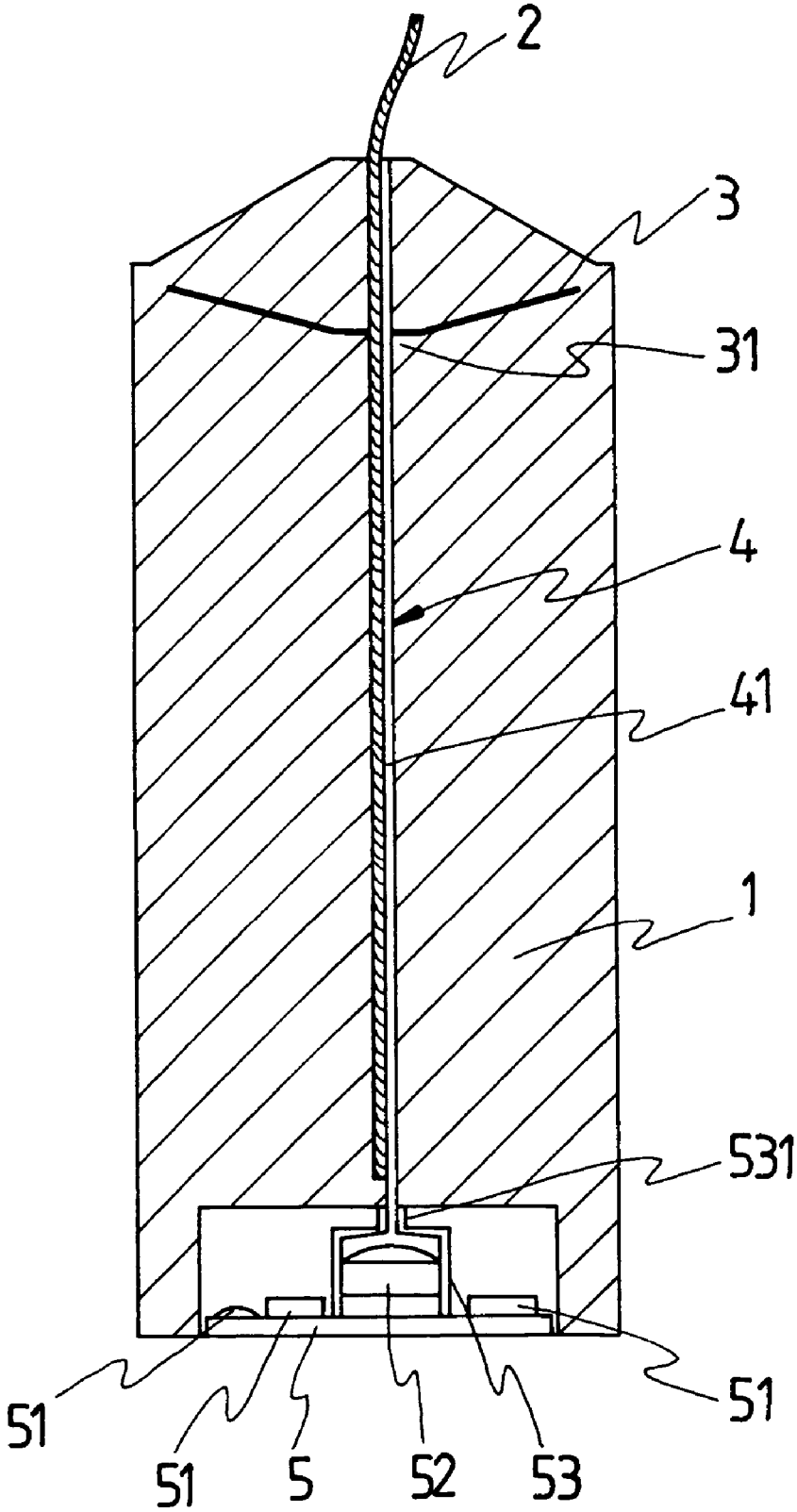
FIG. 2 is a sectional view of an optical fiber of the preferred embodiment of the present invention.

As illustrated in FIG. 2, the conductor 4 relates to an optical fiber 41. An electronic device 51 and a photosensitive device 52 are provided on the circuit board 5. The photosensitive device 52 is fixed to the base of the circuit board 5. A mask 53 related to a circular cup is fixed to the peripheral of the photosensitive device 52 with the bottom of the cup fixed to the circuit board 5. A through hole 531 is provided at the top of the mask 53 for the lower end of the optical fiber 41 to pass through. The optical fiber 41 is connected to the photosensitive device 52 so that the light from the burning wick 2 is emitted through the optical fiber 41 to control the operation of the circuit board 5. The connection between the electronic device 51 and the photosensitive device 52 provided on the circuit board 5 may be provided in the form of integrated circuit block with a diode or a music circuit to realize the control function provided by the photosensitive device 52.

Once the wick 2 is ignited, it emits light and the light passes through the optical fiber 41 of the conductor 4 to the photosensitive device 52 to enable the electronic switch. The candle of the present invention not only controls its inherited electronic supplies to function, such as flaring or music, but also control external equipment through a lead-out terminal.

Figure 3:
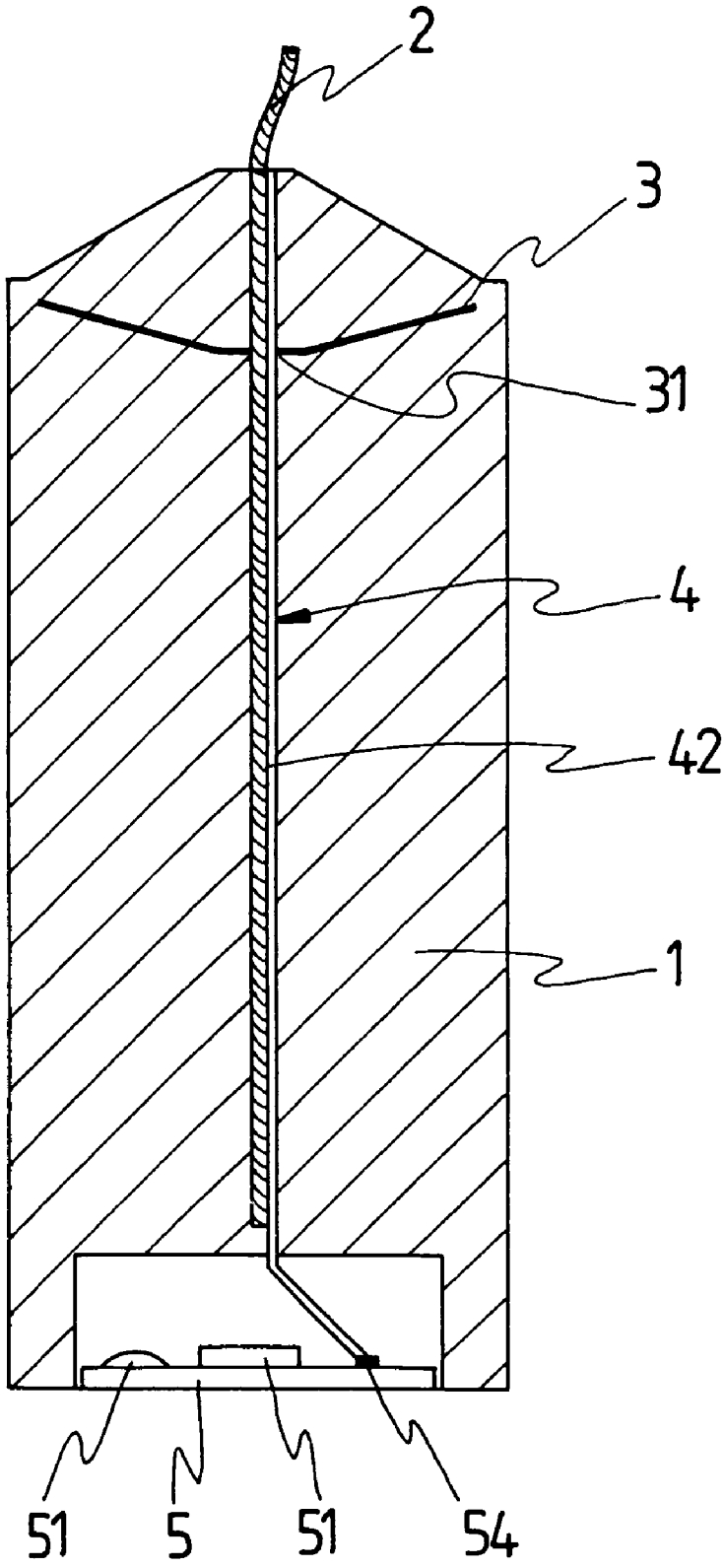
FIG. 3 is a sectional view of a magnet twisted pair cable of the preferred embodiment of the present invention.
Figure 4:
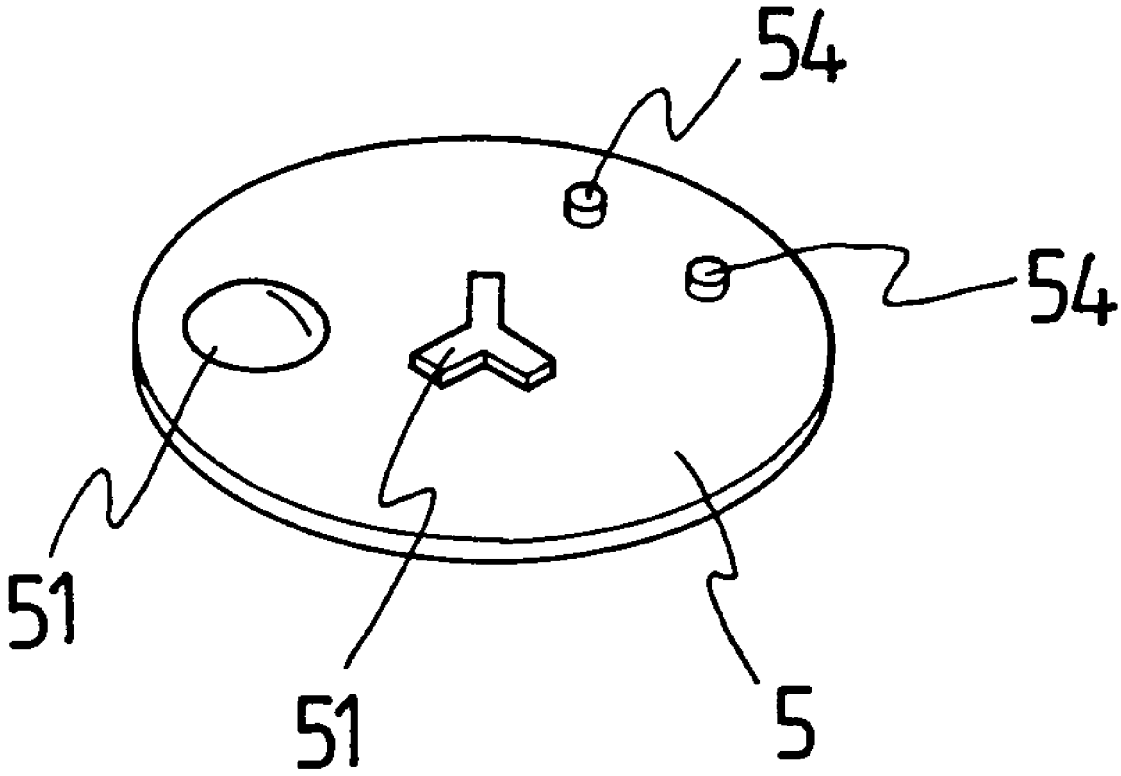
FIG. 4 is a schematic view of a circuit board of the preferred embodiment of the present invention.

Now referring to FIGS. 3 and 4, the conductor 4 of the present invention is provided in the form of a magnet twisted pair cable 42, and the electronic device 51 and two bi-metal switch electrodes 54 are provided on the circuit board 5 by having both of the electronic device 51 and the bi-metal switch electrodes 54 fixed onto the circuit board 5 for the candle to become a flaring or musical candle. Furthermore, both electrodes 54 are connected to an external circuit to realize the function of a candlelight control switch.

In practical use, the wick 2 of the candle 1 is ignited for the candle to emit light, and the coating of the conductor 4 comprised of the magnet twisted pair cable 42 is melted for the cable 42 to be conducted for providing the function of a switch to control the inherited electronic supplies of the candle, such as in the case of a flaring or a musical candle. External equipment can be also controlled by means of connecting a lead-out terminal.

Figure 5:
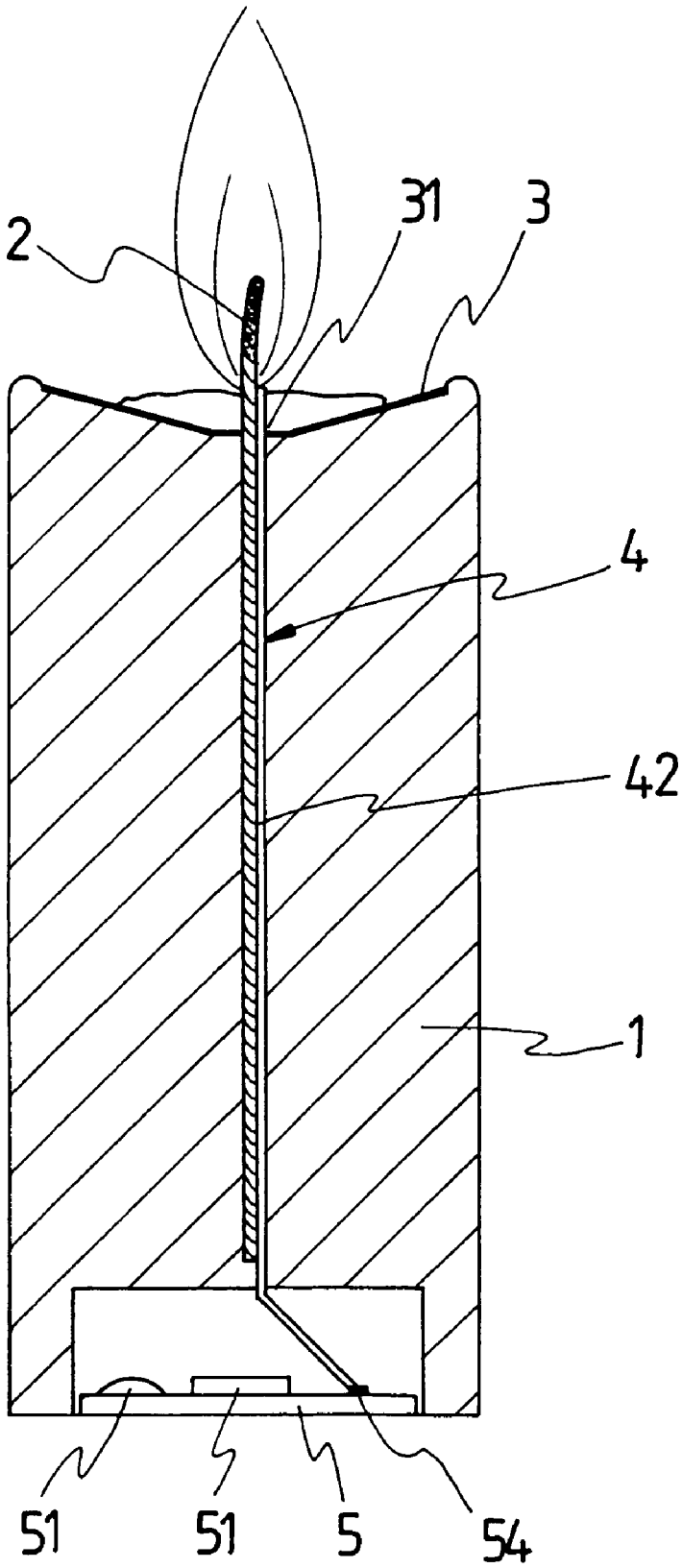
FIG. 5 is a schematic view showing that a metal disk of the preferred embodiment of the present invention when the candle is lighted.

As illustrated in FIG. 5, a V-shaped metal disk 3 is provided in the upper part of the candle 1 and a circular opening 31 is provided at the center of the metal disk 3. The diameter of the outer circumference of the metal disk 3 is slightly smaller than that of the candle 1, and the diameter of the central opening 31 is slightly greater than that of the wick 2 and the conductor 4 put together. The wick 2 and the conductor 4 pass through the central opening 31 of the metal disk 3. Accordingly, once the wick 2 is ignited, the flame of the burning wick 2 will not directly act on the candle 1 surrounding the burning wick 2 to prevent gap from different burning speed to the candle 1 surrounding the wick 2. The flame acts upon the metal disk 3 instead. Since the heat conduction property of the metal disk 3 is consistent, the heated metal disk 3 will evenly melt the candle 1 without causing any drop. With the present of the metal disk 3, it catches the falling wick 2 once the candle 1 is burning out to kill the flame of the wick 2 for achieving improved safety result.

Whereas the metal disk 3 of the present invention indicates a V-shape and may be made from an aluminum foil to take advantage the good reflection result provided by the aluminum foil. The light from the burning candle thus can be reflected up to the ceiling to upgrade the light emission efficiency of the candle. Furthermore, the metal disk 3 may be printed with a letter or a pattern to create artistic or advertising effect on the ceiling as the light from the candle is reflected up to the ceiling.

What is claimed is:

1. An electronic switch for a drop-free candle comprised of a wick inside the candle is characterized by that a metal disk being buried in the upper part of the candle, circular opening being provided at the center of the metal disk for the wick to pass through; a circuit board containing electronic devices being provided at the bottom of the candle; and a conductor being provided along the wick to pass through the circular opening and connect to the circuit board wherein, the conductor is a magnet twisted pair cable having its lower end to connect the circuit board and wherein, the circuit board is provided with the electronic device and two bi-metal switch electrodes; both electrodes being connected to the electronic device; the lower part of the magnet twisted pair cable being split to respectively connect both electrodes of the bi-metal switch.

2. An electronic switch for a drop-free candle comprised of a wick inside the candle is characterized by that a metal disk being buried in the upper part of the candle, circular opening being provided a the center of the metal disk for the wick to pass through; a circuit board containing electronic devices being provided at the bottom of the candle; and a conductor being provided along the wick to pass through the circular opening and connect to the circuit board wherein, metal disk is a V-shaped aluminum foil and the through hole is provided at the center of the aluminum foil.

* * * * *